US006554453B2

(12) United States Patent
Rao

(10) Patent No.: US 6,554,453 B2
(45) Date of Patent: Apr. 29, 2003

(54) LAMP WITH REMOVABLE LENS

(75) Inventor: Raghunatha S. Rao, Darien, IL (US)

(73) Assignee: Litetronics International, Inc., Alsip, IL (US)

( * ) Notice: Subject to any disclaimer, the term of this patent is extended or adjusted under 35 U.S.C. 154(b) by 0 days.

(21) Appl. No.: 09/757,947

(22) Filed: Jan. 10, 2001

(65) Prior Publication Data

US 2001/0002167 A1 May 31, 2001

Related U.S. Application Data

(63) Continuation-in-part of application No. 09/289,237, filed on Apr. 9, 1999.

(51) Int. Cl.[7] ..... F21V 21/29

(52) U.S. Cl. ..... 362/277; 362/374; 362/310; 362/311; 362/378; 313/318.01

(58) Field of Search ..... 362/374, 375, 362/310, 311, 378, 277; 313/318.01, 318.09, 113

(56) References Cited

U.S. PATENT DOCUMENTS

| | | | | |
|---|---|---|---|---|
| 2,629,046 A | * | 2/1953 | Liberman | 362/290 |
| 2,778,929 A | | 1/1957 | Loehr | |
| 2,974,219 A | | 3/1961 | Husby | |
| 3,561,682 A | | 2/1971 | Rex | |
| 3,590,238 A | * | 6/1971 | Arens | 362/285 |
| 4,031,382 A | | 6/1977 | Laughter | |
| 4,091,444 A | | 5/1978 | Mori | |
| 4,117,456 A | | 9/1978 | Albrecht | |
| 4,344,114 A | | 8/1982 | Denhart | |
| 4,363,083 A | | 12/1982 | Tanaka et al. | |
| 4,410,931 A | | 10/1983 | DeCandia et al. | |
| 4,516,196 A | | 5/1985 | Blake | |
| 4,520,436 A | | 5/1985 | McNair et al. | |
| 4,593,344 A | | 6/1986 | Basile | |
| 4,654,768 A | | 3/1987 | Dryman et al. | |
| 4,816,977 A | | 3/1989 | Sorensen | |
| 4,868,727 A | | 9/1989 | Ponds et al. | |
| 4,878,159 A | | 10/1989 | Blaisdell et al. | |
| 4,958,266 A | | 9/1990 | Sorensen et al. | |
| 5,119,276 A | | 6/1992 | Suzuki | |
| 5,465,025 A | | 11/1995 | Hendrickson | |
| 5,467,260 A | | 11/1995 | Aspenwall | |
| 5,839,822 A | | 11/1998 | Oechsle | |

OTHER PUBLICATIONS

Litetronics International "Replaceable Ultrapar™ Lamps" brochure, published prior to Apr. 1998.

* cited by examiner

*Primary Examiner*—Sandra O'Shea
*Assistant Examiner*—Ronald E. DelGizzi
(74) *Attorney, Agent, or Firm*—Seyfarth Shaw

(57) ABSTRACT

A lamp having a threaded base for threadedly coupling to an electrical energy source is provided. The lamp includes a light-generating bulb replaceably coupled to the threaded base and a housing coupled to the base. The housing has an inner light-directing surface disposed about the bulb. The housing terminates at an outer rim, and defines an opening. A mounting assembly, including a lens-holding ring with a keeper and a latch hook on the sidewall, removably mounts a lens on the rim in a covering position closing the opening, whereby removal of the lens permits access to the bulb. The lens holding ring may be separable from the housing or may be pivotally coupled to a ring on the housing.

21 Claims, 6 Drawing Sheets

LAMP WITH REMOVABLE LENS

RELATED APPLICATION

This application is a continuation-in-part of co-pending U.S. application Ser. No. 09/289,237, filed Apr. 9, 1999, entitled "Lamp With Removable Lens."

BACKGROUND

This invention relates to lamps, and more particularly, to lamps having threaded bases.

In the past, lamps used in display lighting, such as flood lighting and spot lighting, commonly include a bulb contained within a generally frustoconical glass envelope coupled to a threaded base for connection to an electrical socket. The interior of the envelope is metallized to define a reflector. To provide a whiter light throughout its life, the bulb may be filled with a gas, such as a halogen gas. When such a bulb burns out, the entire lamp is usually discarded and replaced with a new one. When used in retail stores and other commercial installations, these lamps are on for many hours of each day. Thus, they must be replaced frequently. The combination of the cost of the bulb-within an-outer-envelope construction and the frequency of replacing the lamp used in display lighting makes such lamps expensive to use.

Lamps have also been provided which have a threaded base detachable from the glass envelope. This allows a user access to the interior of the lamp to replace burnt out bulbs, but requires the user to first unscrew the lamp from the socket. Often, the lamps, when connected to the socket, are in tight quarters making removal from the socket difficult and often time consuming.

SUMMARY

It is a general object of the invention to provide a lamp which avoids the disadvantages of prior lamps while affording additional structural and operational advantages.

An important feature of the invention is the provision of a lamp which is of a relatively simple and economical construction.

In connection with the above feature, another feature of the invention is the provision of a lamp which provides cost reduction by providing for replacement of the bulb of the lamp, thereby permitting the reuse of the outer envelope, the lens and other elements of the lamp.

A further feature of the invention is the provision of a lamp of the type set forth that does not need to be removed from an attached socket to change the bulb.

Certain ones of these and other features of the invention maybe attained by providing a lamp comprising: a threaded base for threadedly coupling to an electrical energy source and having a pair of female terminals; a light-generating bulb having a pair of male terminals removably receivable in the female terminals; a reflective housing connected to the base and having an inner light-directing surface disposed about the bulb, the reflective housing terminating at an outer rim, and defining an opening; a lens; and a mounting assembly mounting the lens on the rim in a covering position closing the opening and accommodating movement of the lens to a non-covering position wherein at least a portion of the opening is uncovered to permit access to the bulb through the opening.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION

Figure 1:
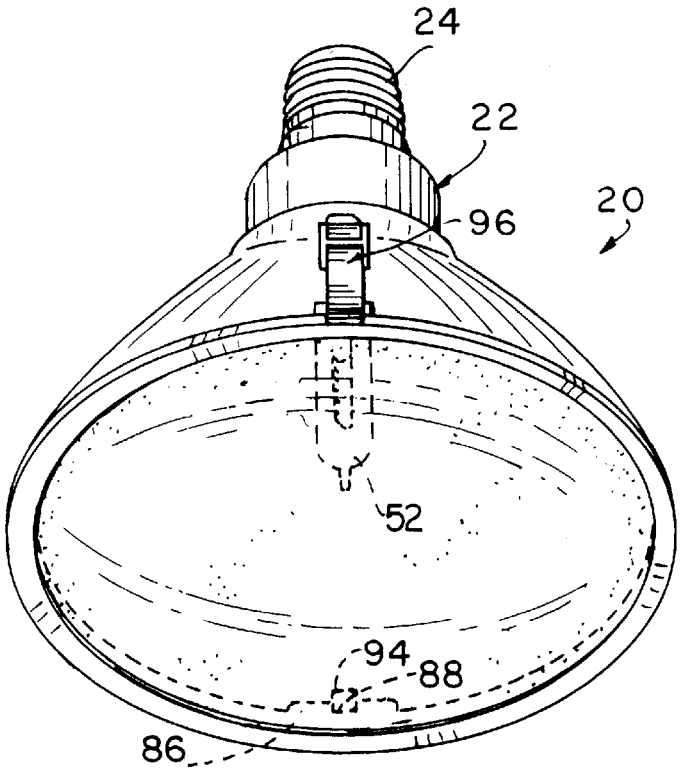
FIG. 1 is a perspective view of the lamp of the present invention with the lens mounted in place.
Figure 3:
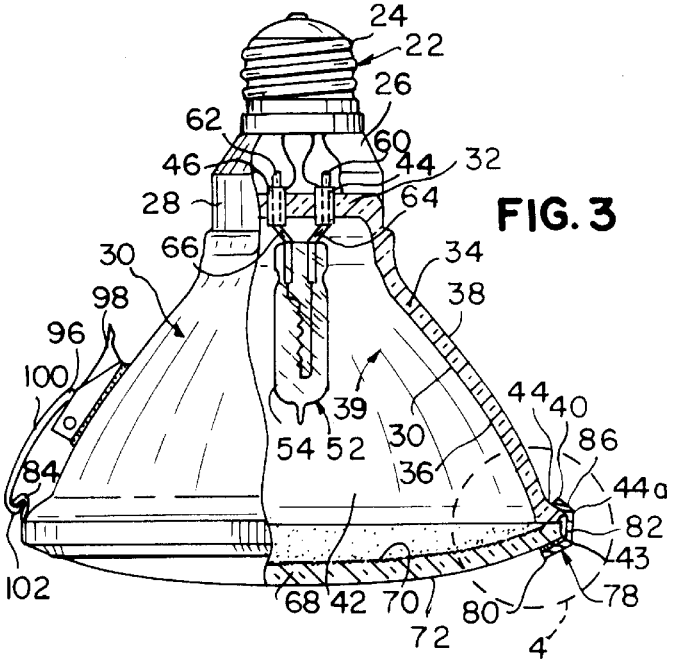
FIG. 3 is a side elevational view of the lamp of FIG. 1, partially in section.
Figure 6:
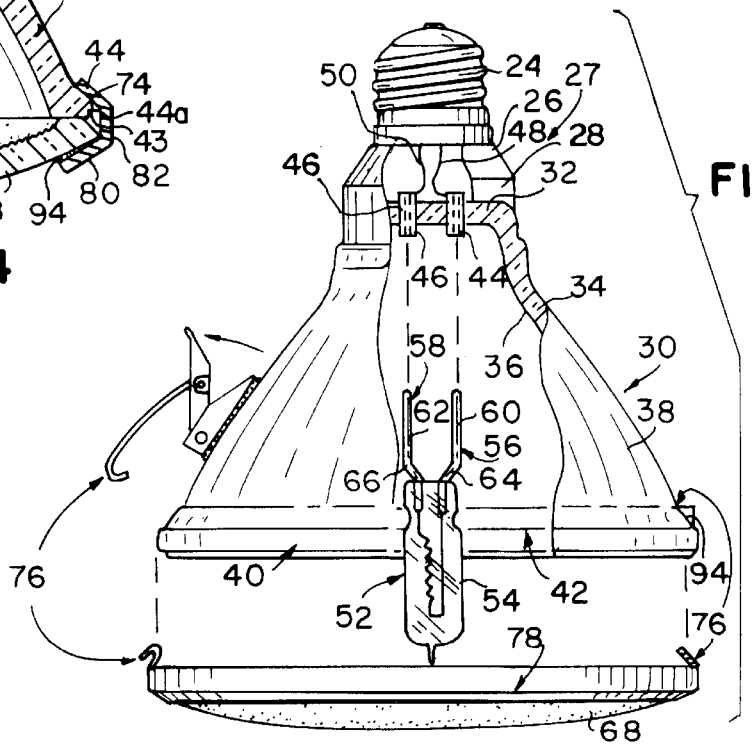
FIG. 6 is an front elevational view of the lamp of FIG. 1, with the glass envelope partially broken away and the lens detached.

Referring to FIGS. 1, 3 and 6, a lamp 20 is provided. The lamp 20 includes a threaded base assembly 22 including a cup-shaped threaded end portion 24 adapted to be threadedly engaged to an associated lamp receptacle (not shown), for electrical connection thereto in a known manner. The threaded end portion 24 is integral with a flared frustoconical shoulder 26, which terminates in a cylindrical wall portion 28.

The lamp 20 also includes an envelope or housing 30 fixedly coupled to the base assembly 22 in a known manner.

The envelope 30 is typically formed of glass and, as seen in FIGS. 3 and 6, has an end wall 32 and a generally frustoconical-shaped sidewall 34 having interior and exterior surfaces 36, 38.

Figure 4:
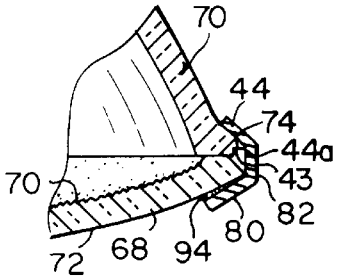
FIG. 4 is an enlarged fragmentary view of the circled area of FIG. 3.

The interior surface 36 is provided with a reflector material to form a reflector 39 or light directing surface. The sidewall 34 terminates at a rim 40 which defines a circular opening 42 (FIG. 6). As seen in FIG. 4, the rim 40 has a groove 43 about its periphery. The rim 40 also defines a shoulder surface 44 which projects radially outwardly from the exterior surface 38 to an annular terminal edge 44*a* (FIGS. 3, 4 and 6).

As seen in FIGS. 3 and 6, two electrical clamps, or connectors 45, 46, defining female terminals, are disposed in the end wall 32 of the envelope 30 and are respectively electrically connected to the threaded end portion 24 of the base assembly 22 by wires 48, 50 in a known manner.

As seen in FIG. 4, the lamp 20 also includes a light-generating bulb 52, such as a halogen bulb, having a capsule 54 made of hard glass or quartz and a pair of connecting legs, or male terminals 56, 58. Legs 56, 58 respectively have parallel end portions 60, 62 respectively connected to inclined portions 64, 66 which converge toward each other. The parallel portions 60, 62 are respectively removably disposable in clamps 45, 46. The clamps 45, 46 are preferably spring loaded to maintain the parallel portions 60, 62 therein to maintain electrical contact. As seen in FIG. 3, the inclined portions 64, 66 contact the upper portion of the clamps 45, 46 to prevent the end portions 60, 62 from being inserted too deeply into the clamps 45, 46 and to properly align the capsule 54 at the focal point of the reflector 39 which is disposed about the capsule 54.

The lamp 20 also includes a lens 68, preferably formed of glass, to focus or direct light in a predetermined beam pattern, such as, among others, spot, flood and wide flood.

The lamp 20 also includes a mounting assembly 76 to mount the lens 68 in a covering position, as seen in FIGS. 1 and 3, on the rim 40 to close the opening 42 and to position the lens 68 properly to direct the light from the light generating bulb 52. As seen best in FIG. 4, the lens 68 has interior and exterior surfaces 70, 72 and a raised rim 74 about the periphery of the interior surface 70. When the lens 68 is in the covering position, the raised rim 74 is disposed in the groove 43.

Figure 2:
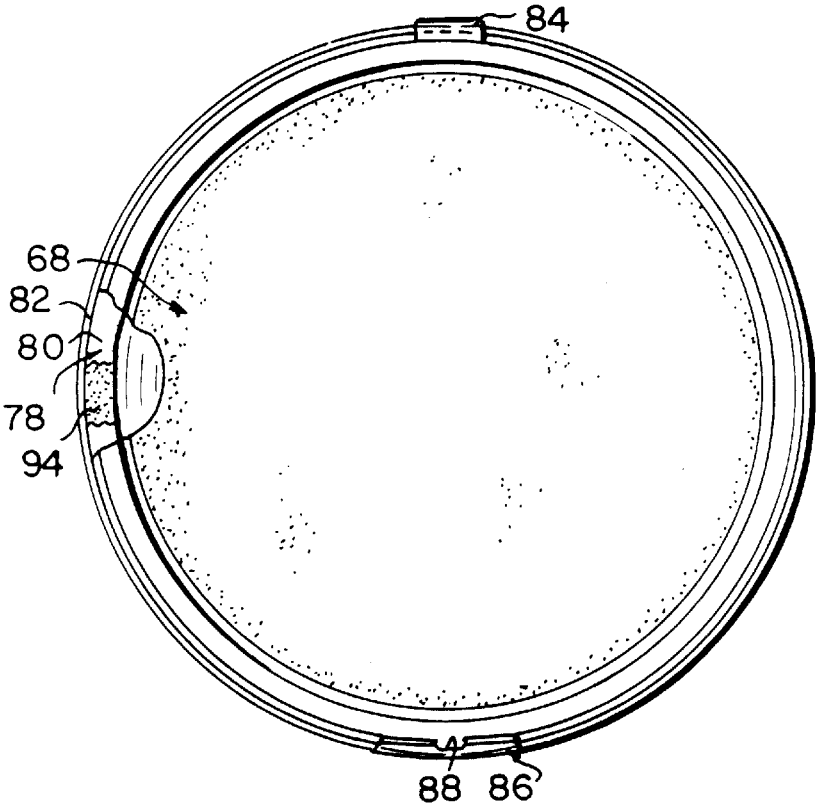
FIG. 2 is a bottom plan view, partially broken away, of the lamp of FIG. 1.

The mounting assembly 76 includes a ring-like lens holder 78 made of a metal, or other suitable material, which can withstand the operating temperatures of the lamp 20. The lens holder 78 has an annular bottom wall 80 integral with, and inclined to, an upstanding cylindrical sidewall 82. The lens holder 78 also includes a latch keeper 84 projecting up from the top of the sidewall 82 and a flange 86 also projecting up and radially inwardly from the top of the sidewall 82 and inclined with respect to the sidewall 82. The flange 86, as seen best in FIGS. 1, 2 and 8, includes a centrally disposed slot 88 formed of two generally parallel sidewalls 90 and a bottom wall 92 connecting the two. The flange 86 is spaced about 180° from the keeper 84. The lens holder 78 may be adhesively attached to the lens 68 by means of an adhesive 79 (FIG. 2), such as an epoxy, disposed between the bottom wall 80 and the lens 68, or may be attached by mechanical means. The lens holder 78 can also be free from the lens 68.

The mounting assembly 76 also includes a box-like lug 94 projecting from the exterior surface 38 of the envelope 30 adjacent to the rim 40. The mounting assembly 76 also includes a latch hook assembly 96 disposed about 180° away from the lug 94 (FIG. 6) and adhesively attached to the exterior surface 38 of the envelope 30. The hook assembly 96 includes an operating lever 98 and a latch hook 100 having a hooked end 102.

Figure 7:
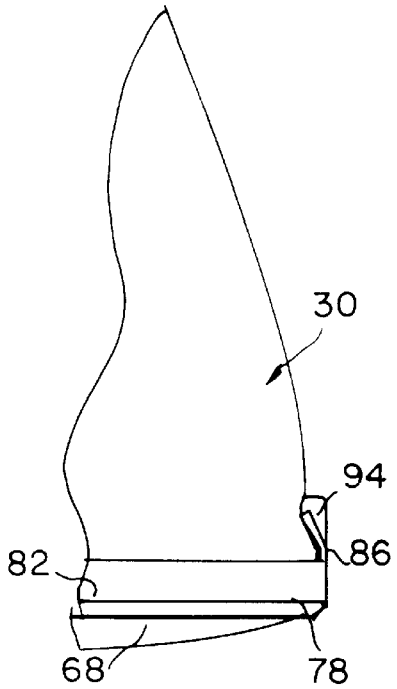
FIG. 7 is a fragmentary, front elevational view of the lug and slot of the lens mounting assembly engaged with each other.
Figure 8:
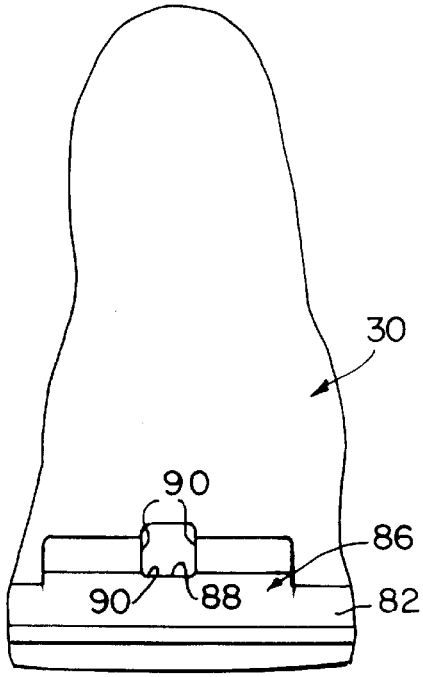
FIG. 8 is a fragmentary, right-hand side elevational view of the lamp of FIG. 7.
Figure 9:
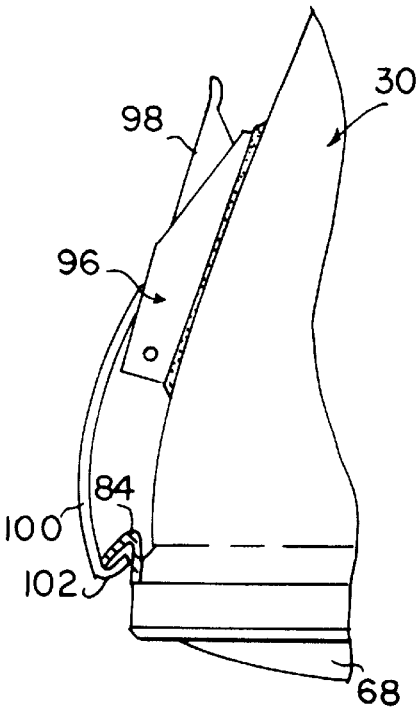
FIG. 9 is an enlarged, fragmentary, front elevational view of the left-hand side of FIG. 3.
Figure 10:
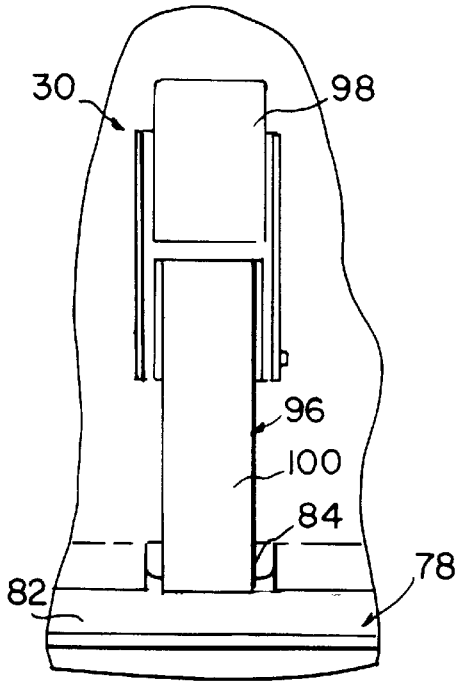
FIG. 10 is a fragmentary, left-hand side elevational view of the lamp of FIG. 9.
Figure 11:
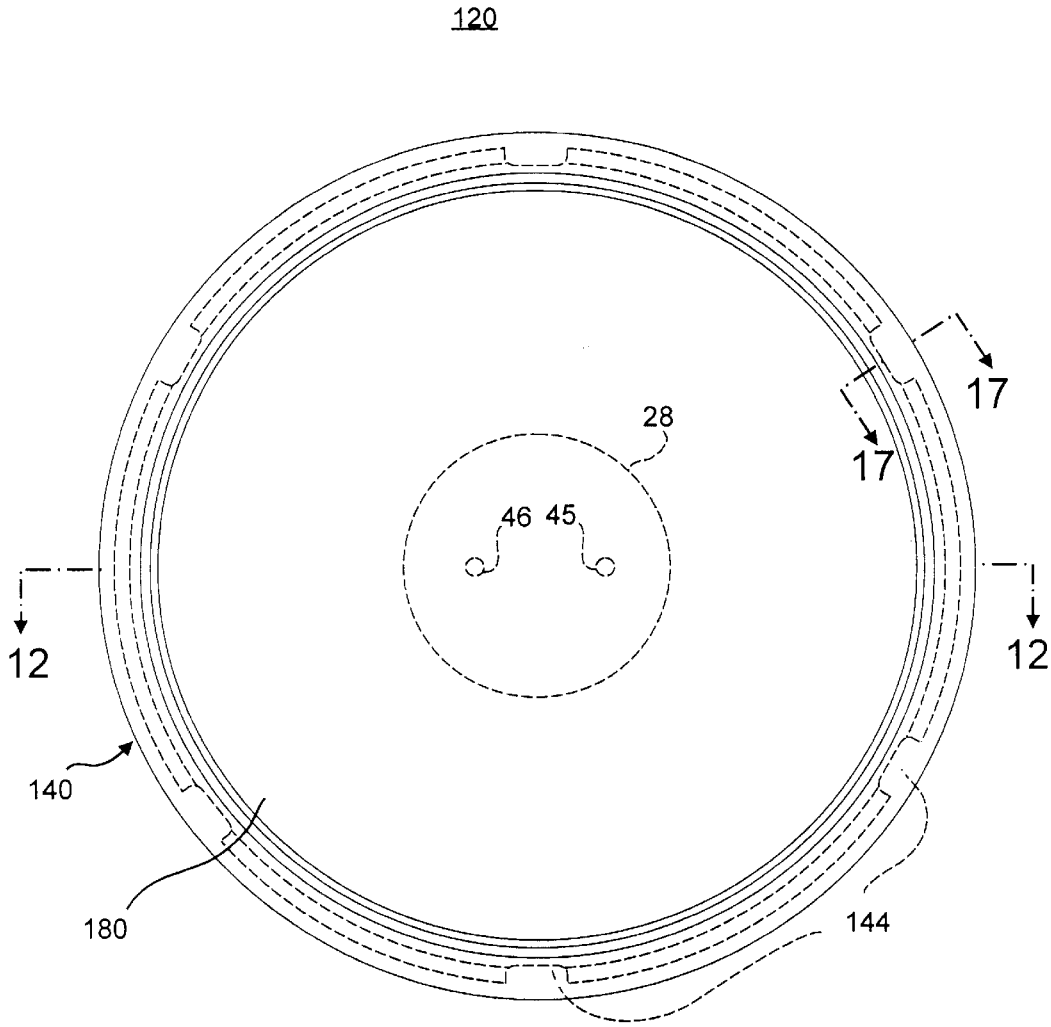
FIG. 11 is a bottom plan view of another lamp embodiment.

When the lens 68 is in the covering position, the slot 88 of the flange 86, as seen in FIGS. 1, 7 and 8, is aligned with the lug 94, so that lug 94 is disposed between the sidewalls 90 of the slot 88, which prevents the lens holder 78 from rotating with respect to the envelope 30. Additionally, portions of the radially inwardly projecting flange 86 rest on shoulder surface 44, which aid in supporting the lens 68 on the envelope 30 (FIGS. 3, 4 and 7).

Figure 5:
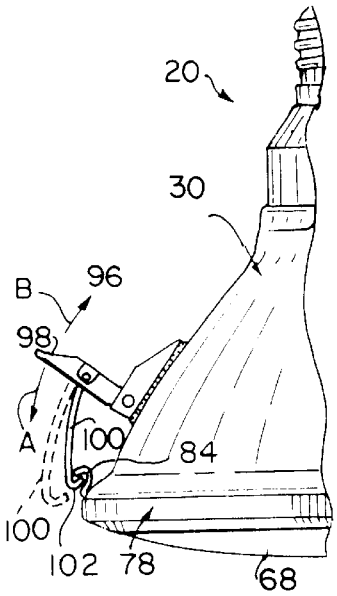
FIG. 5 is a fragmentary, front elevational view of the lens of FIG. 1, wherein the latch has been moved to a non-engaged position.

Also, when the lens 68 is in the covering position, the hooked end 102 of the latch hook 100 is engageable with the keeper 84 of the lens holder 78, as illustrated in FIGS. 3 and 5.

To remove the lens 68 from the covering, the operating lever 98, as seen in FIGS. 3 and 5, is rotated from the position shown in FIG. 3, in the direction of arrow A (FIG. 5), which disengages the hooked end 102 of the latch hook 100 from the keeper 84. The operating lever 98 can then be rotated in the direction of arrow B (FIG. 5) to provide clearance between the hooked end 102 of the hook 100 and the keeper 84 so a user can pull the lens holder 78 and lens 68 away from the opening 42 (and the rim 40), as seen in FIG. 6, to a non-covering position, and thereby can gain access to the light-generating bulb 52 for replacement or repair. After replacement, the lens 68 (and lens holder 78) are returned into the covering position shown in FIGS. 1 and 3.

While, the mounting assembly 76 accommodates complete removal of the lens 68 from the envelope 30, it is contemplated that the lens 68 could also remain coupled to the envelope 30 but moved to a position which leaves at least a portion of the opening 42 uncovered to provide access to the light-generating bulb 52. More specifically, referring now to FIGS. 11–17, there is illustrated another lamp embodiment, generally designated by 120, which is similar to the lamp 20 of FIGS. 1–10, but utilizes a different lens mounting assembly. Accordingly, parts of the lamps 20 and 120 which are the same will bear the same reference numbers.

The lamp 120 has an envelope or housing 130 fixedly coupled to the base 22 in the same manner as described above for the lamp 20. The envelope 130 has a generally frustoconical-shaped side wall 132 with an exterior surface 133 and terminating at a rim 134 (FIG. 17) which defines the circular opening 42. The rim 134 has a frustoconical outer surface portion 134*a* and a cylindrical surface portion 135 which terminates at an annular outer end surface 136 lying in a plane substantially perpendicular to the axis of the lamp 120. An annular rib 137 projects axially forwardly from the end surface 136 and joins it to an annular inner end surface 138 substantially parallel to the outer end surface 136. Projecting generally radially outwardly from the exterior surface 133 of the side wall 132 at diametrically opposed locations thereon are two generally prism-shaped lugs 139 (one shown in FIG. 16).

Figure 12:
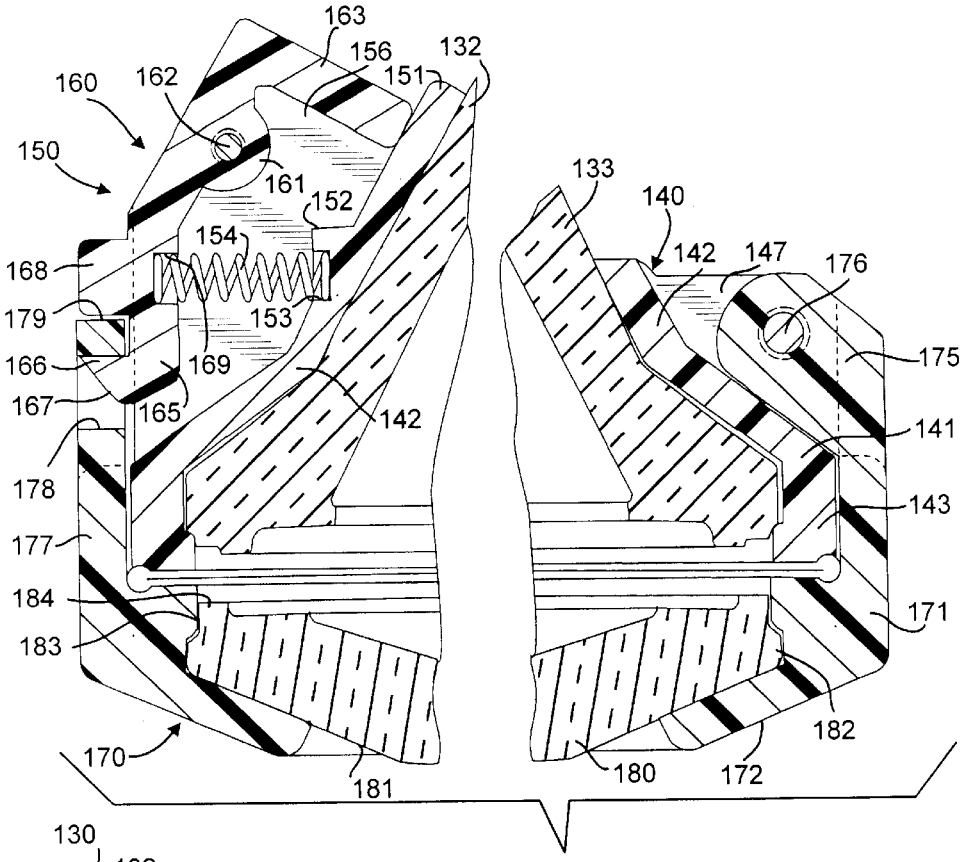
FIG. 12 is an enlarged, fragmentary view in vertical section taken generally along the line 12—12 in FIG. 11.
Figure 16:
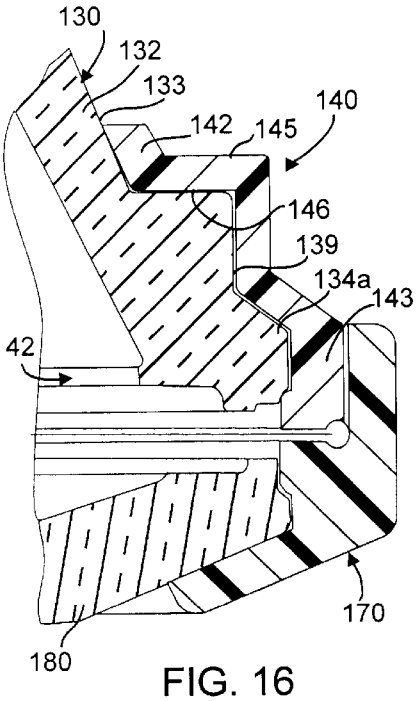
FIG. 16 is a fragmentary sectional view taken generally along the line 16—16 in FIG. 14.
Figure 17:
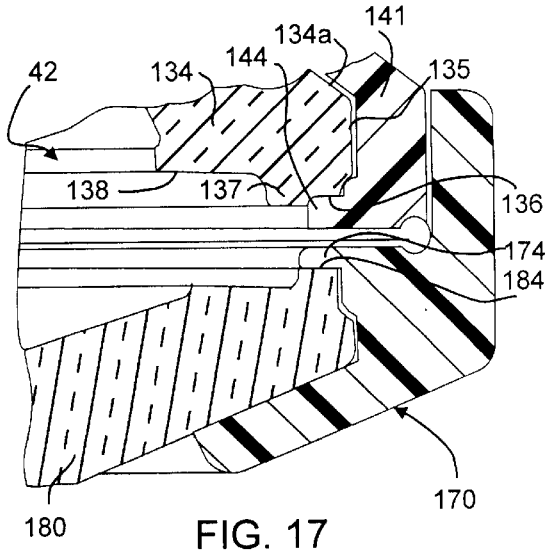
FIG. 17 is an enlarged, fragmentary, sectional view, taken generally along the line 17—17 in FIG. 11.
Figure 15:
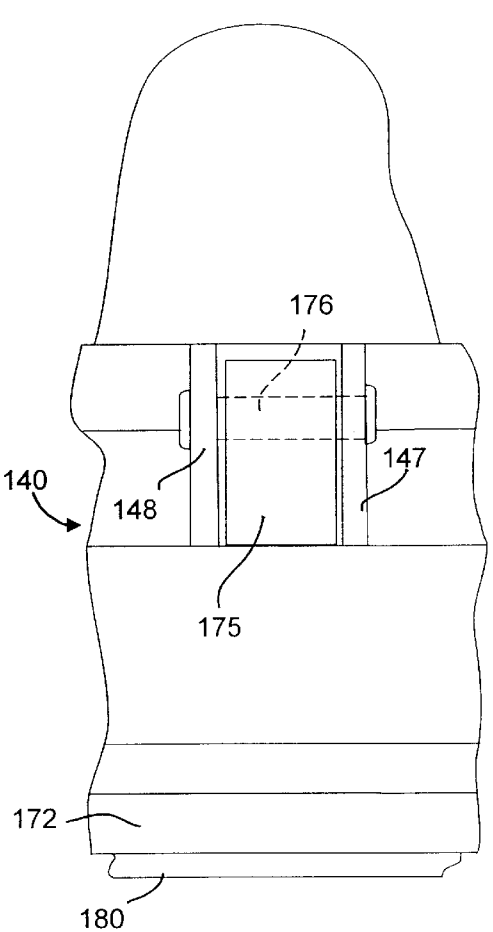
FIG. 15 is a fragmentary, side elevational view of the lamp of FIG. 12, as viewed from the right-hand side thereof.
Figure 14:
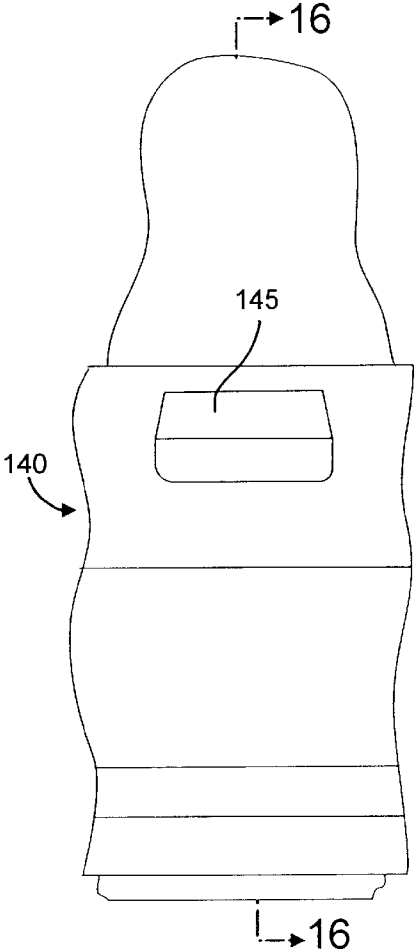
FIG. 14 is an enlarged, fragmentary, top plan view of the lamp of FIG. 11.
Figure 13:
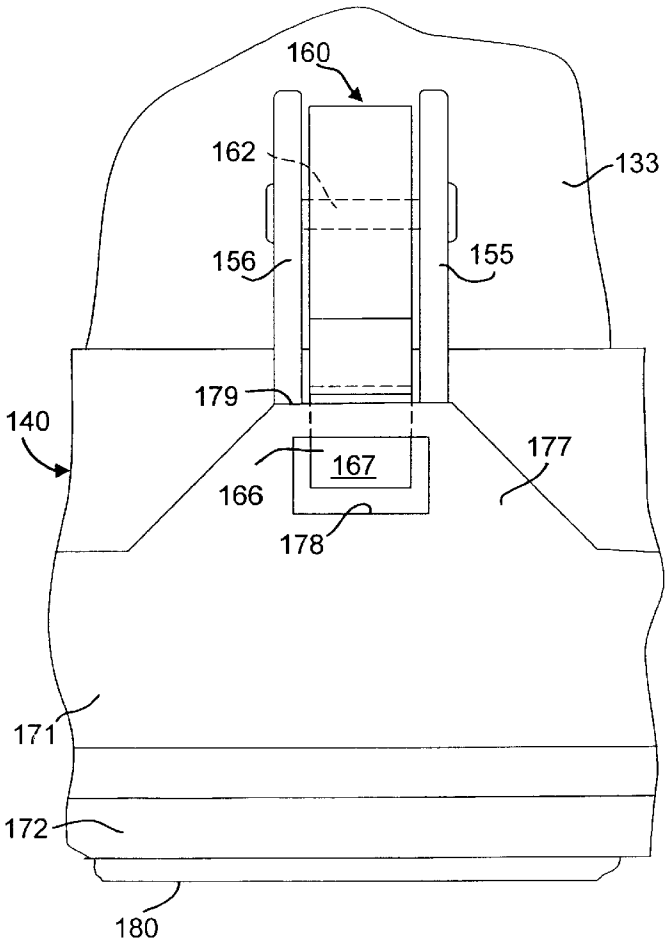
FIG. 13 is a fragmentary, side elevational view of the lamp of FIG. 12, as viewed from the left-hand side thereof.

Encompassing the rim 134 and fixedly secured thereto is a housing ring, generally designated by the numeral 140, which may be formed of a suitable plastic material. Referring, in particular, to FIGS. 12, 16 and 17, the ring 140 has a frustoconical wall 141 integral at its upper end with a more sharply-sloped frustoconical flange 142 and integral at its lower end with a depending, cylindrical flange 143, the ring 140 being so dimensioned that the wall 141 and the flanges 142 and 143, respectively, lie along the outer surface 134a of the rim 134, the exterior surface 133 of the envelope side wall 132 and the cylindrical surface 135 of the rim 134. At a plurality of equiangularly spaced locations therearound, the cylindrical flange 143 is provided with radially inwardly extending retaining flanges 144 (one shown in FIG. 17) which underlie and engage the outer end surface 136 of the rim 134 for fixedly retaining the ring 140 in place on the envelope 130. The retaining flanges 144 may be formed by ultrasonic deformation of the cylindrical flange 143 or by ultrasonic attachment to that flange of separate retaining pieces, after the ring 140 is positioned in place on the rim 134. Formed at diametrically opposed locations on the ring 140 and projecting radially outwardly therefrom are two generally prism-shaped bosses (one shown in FIGS. 14 and 16), respectively defining recesses 146 for receiving the lugs 139 and cooperating therewith to prevent rotation of the ring 140 relative to the envelope 130. Projecting radially outwardly from the ring 140, substantially midway between the bosses 145, is a pair of generally triangular hinge flanges 147 and 148 (FIGS. 12 and 13).

The lamp 120 includes a latch mechanism, generally designated by the numeral150, which includes an extension 151 of the frustoconical flange 142 of the ring 140, disposed diametrically opposite the hinge flanges 147 and 148. Projecting radially outwardly from the extension 151 is a short, cylindrical boss 152 which defines a cylindrical recess 153, receiving one end of a helical compression spring 154. Also projecting radially outwardly from the extension 151 and the adjacent portions of the ring wall 141 and flange 142, respectively on opposite sides of the boss 152, are two pivot flanges 155 and 156 (FIGS. 12 and 13). The latch mechanism 150 also includes a latch hook 160 disposed between the pivot flanges 155 and 156 and having a hub 161. A pivot pin 162 is received through complementary openings in the hub 162 and the pivot flanges 155 and 156 for mounting the latch hook 160 for pivotal movement between latching and unlatching positions. Integral with the hub 162 at one end thereof is a stop flange 163 designed to engage the extension 151 in the latching position of the latch hook 160, illustrated in FIGS. 12 and 13. Also integral with the hub 160 and depending therefrom is a hook flange 165 provided at its distal end with a radially outwardly projecting hook lip 166 having an inclined cam surface 167 thereon. Projecting radially outwardly from the hook flange 165 and spaced a slight distance from the hook lip 166 is a stop lug 168. Formed in the inner surface of the hook flange 165 behind the stop lug 168 is a spring recess 169 which receives the other end of the spring 154. Thus, it will be appreciated that the spring 154 resiliently urges the latch hook 160 to its latching position, illustrated in FIG. 12.

The lamp 120 also includes an annular lens ring 170, which may be formed of the same plastic material as the housing ring 140, and includes a cylindrical wall 171, integral at its forward end with a radially inwardly and forwardly projecting frustoconical flange 142. Also projecting radially inwardly from the cylindrical wall 171 a slight distance rearwardly of the flange 172 is an annular seating rim 172, which has radially inwardly projecting therefrom, at equiangularly spacedapart locations thereon, a plurality of retaining flanges 174 (one shown in FIG. 17). Extending axially rearwardly and radially inwardly from the cylindrical wall 171 is a hinge arm 175, disposed in use between the hinge flanges 147 and 148 of the housing ring 140. A hinge pin 176 is received through complementary openings in the hinge arm 175 and the hinge flanges 147 and 148 for accommodating pivotal movement of the lens ring 170 between a covering position, illustrated in the drawings, and an uncovering position (not shown). Also extending axially rearwardly from the cylindrical wall 171 diametrically opposite the hinge arm 175, and forming a part of the latch mechanism 150, is a generally trapezoidal-shaped keeper arm 177 (FIGS. 12 and 13) having a rectangular slot 178 formed therethrough and defining at its upper edge a cam surface 179.

The rings 140 and 170 cooperate to form a mounting assembly for a lens 180, similar to the lens 68 of the lamp 20. The lens 180 has a sloping front surface 181 and stepped cylindrical rim surfaces 182 and 183, the latter terminating at an annular rear rim surface 184. In use, the surfaces 181–183, respectively, lie along the frustoconical flange 172, the cylindrical wall 171 and the seating rim 173 of the lens ring 170 (see FIG. 12), with the retaining flanges 174 disposed for engagement with the rear rim surface 184 of the lens 180 (see FIG. 17) for securely fixing it in place in the lens ring 170. The retaining flanges 174 may be formed in the same manner as was described above for the retaining flanges 144 of the housing ring 140, after the lens 180 has been assembled in the lens ring 170.

It will be appreciated that, in use, the lens 180 pivots with the lens ring 170 between the covering and uncovering positions. In the uncovering position, the lens 180 can be moved out of alignment with the envelope opening 42 to permit access to the bulb, as described above. When the lens ring 170 is pivoted from its uncovering position to its covering position, the cam surface 179 on the keeper arm 177 engages the cam surface 167 of the latch hook 160 for pivoting the latch hook 160 in a counter-clockwise direction, as viewed in FIG. 12, against the urging of the spring 154, to permit passage of the keeper arm 177. As the keeper arm 177 moves past the hook lip 166, the hook lip 166 will snap into engagement in the keeper slot 178 under the urging of the spring 154 to latch the lens ring 170 and the lens 180 in their covering position, further movement of the lens ring 170 being limited by engagement of the cam surface 179 with the stop lug 168. In order to release the latch mechanism 150, the user simply depresses the latch hook 160, as by pushing on the stop lug 168, to release the hook lip 166 from the keeper slot 178.

While the rings 140 and 170 are described as formed of plastic material, it will be appreciated that other materials could be used, and other techniques could also be utilized for assembling them to the envelope 130 and the lens 180, respectively.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A lamp comprising:

a threaded base for threadedly coupling to an electrical energy source and having a pair of female socket-type terminals;

a light-generating bulb having a pair of male plug-type terminals removably receivable in the female terminals;

a reflective housing connected to the base and having an inner light-directing surface disposed about the bulb, the reflective housing terminating at an outer rim, and defining an opening;

a lens; and a mounting assembly mounting the lens on the rim in a covering position closing the opening and accommodating movement of the lens to a non-covering position wherein at least a portion of the opening is uncovered to permit access to the bulb through the opening.

2. The lamp of claim 1, wherein the mounting assembly includes a lens holder encircling the lens and releasably coupled to the housing, wherein when the lens is in the covering position, the lens holder is coupled to the housing.

3. The lamp of claim 2, wherein the lens holder includes a first locking structure and the housing carries a second locking structure engageable with the first locking structure, wherein when the lens is in the covering position and the first and second locking structures are engaged with each other, the lens holder is coupled to the rim.

4. The lamp of claim 3, wherein the first locking structure is a latch keeper and the second locking structure is a latch hook.

5. The lamp of claim 1, wherein the mounting assembly includes a lens holder encircling the lens and moveable therewith between the covering and non-covering positions.

6. The lamp of claim 5, wherein the lens holder is affixed to the lens.

7. The lamp of claim 1, wherein the mounting assembly accommodates removal of the lens from the rim.

8. The lamp of claim 1, wherein the mounting assembly permanently couples the lens to the rim.

9. The lamp of claim 1, wherein the mounting assembly includes a first part fixed to the housing and a second part fixed to the lens and hingedly connected to the first part for movement between the covering and non-covering positions.

10. A lamp comprising:

a threaded base;

a reflective housing connected to the base and including a sidewall having interior and exterior surfaces and terminating at a rim and defining an opening;

a light generating bulb disposed in the housing and replaceably coupled to the base;

a light transmitting cover; and a mounting assembly mounting the cover on the rim, the mounting assembly including a first ring disposed about the cover and discrete therefrom and a second ring disposed about the rim and discrete therefrom, and hinge structure hingedly coupling to the first ring to the second ring for accommodating pivotal movement of the cover between a covering position closing the opening and a non-covering position wherein at least a portion of the opening is uncovered to permit access to the bulb through the opening, the mounting assembly including locking structure for latching the cover in the covering position.

11. The lamp of claim 10, wherein said sidewall includes a shoulder surface projecting radially outwardly from the exterior surface and having an outer radial edge, and wherein the first ring includes a flange directed radially inwardly, wherein when the cover is in the covering position the flange is engaged with and extends radially inwardly of the edge of the shoulder surface.

12. The lamp of claim 10, wherein the mounting assembly includes a lug formed on one of the first ring and the exterior surface of the side wall, and a slot disposed on the other of the first ring and the exterior surface of the side wall for receiving the lug, wherein in the covering position the lug is disposed in the slot.

13. The lamp of claim 10, wherein the second ring is fixed to the housing.

14. The lamp of claim 10, wherein the locking structure is disposed on the rings.

15. The lamp of claim 10, wherein the locking structure is diametrically spaced from the hinge structure.

16. The lamp of claim 10, wherein the locking structure includes a latch member pivotally moveable between latching and unlatching positions.

17. The lamp of claims 16, wherein the latch member is biased to the latching position.

18. The lamp of claim 17, wherein the locking structure includes a keeper member having a cam surface permitting it to move past the latch member to the latching position.

19. The lamp of claim 10, wherein the rings are formed of a plastic material.

20. The lamp of claim 10, and further comprising first and second structures respectively formed on the second ring and the housing to prevent relative rotational movement thereof.

21. The lamp of claim 10, and further comprising retaining structure on each ring for fixing the ring in place on the associated lens or housing.

* * * * *